United States Patent [19]

Appelbaum

[11] Patent Number: 4,477,070

[45] Date of Patent: Oct. 16, 1984

[54] FOLD-AWAY REBOUND EXERCISE DEVICE

[75] Inventor: Paul Appelbaum, Denver, Colo.

[73] Assignee: Jog-et, Inc., Englewood, Colo.

[21] Appl. No.: 402,912

[22] Filed: Jul. 29, 1982

[51] Int. Cl.[3] ..... A63B 23/04; A63B 5/18

[52] U.S. Cl. ..... 272/70; 272/65; 272/DIG. 9

[58] Field of Search ..... 272/65, 70, 144, 134, 272/DIG. 9; 182/35; 5/2 R, 2 B, 6, 7, 3, 4, 133, 136, 159 R, 164 R, 164 B, 164 C, 164 D, 164 E; 248/489; 16/19, 32, 33, 34

[56] References Cited

U.S. PATENT DOCUMENTS

| | | | |
|---|---|---|---|
| 251,949 | 1/1882 | Risdon | 16/32 |
| 1,032,006 | 7/1912 | Hyde | 16/32 |
| 1,542,766 | 6/1925 | Hall | 272/144 X |
| 1,687,338 | 10/1928 | Kaufman | 5/2 R X |
| 1,725,404 | 8/1929 | Matheson | 5/164 C X |
| 2,324,970 | 7/1943 | Woolley | 272/65 |
| 2,672,624 | 3/1954 | Giuseffi | 5/159 R X |
| 3,046,572 | 7/1962 | Eames et al. | 5/136 |
| 3,874,657 | 4/1975 | Niebojewski | 272/144 X |
| 4,336,933 | 6/1982 | Appelbaum | 272/70 |

FOREIGN PATENT DOCUMENTS

| | | | |
|---|---|---|---|
| 586526 | 11/1959 | Canada | 5/2 R |
| 1375015 | 9/1964 | France | 5/6 |
| 548651 | 9/1956 | Italy | 16/33 |
| 724244 | 2/1955 | United Kingdom | 272/65 |

*Primary Examiner*—Robert A. Hafer
*Assistant Examiner*—Arnold W. Kramer
*Attorney, Agent, or Firm*—Charles C. Corbin

[57] ABSTRACT

A portable apparatus for in-place jogging including a housing to which is pivotally mounted a structure that supports a jogging surface, the support structure having an in-use position in which it is locked at 90 degrees to the housing, and a fold-away position in which it is rotated and folded into a cavity within the housing.

3 Claims, 2 Drawing Figures

Fig. 1
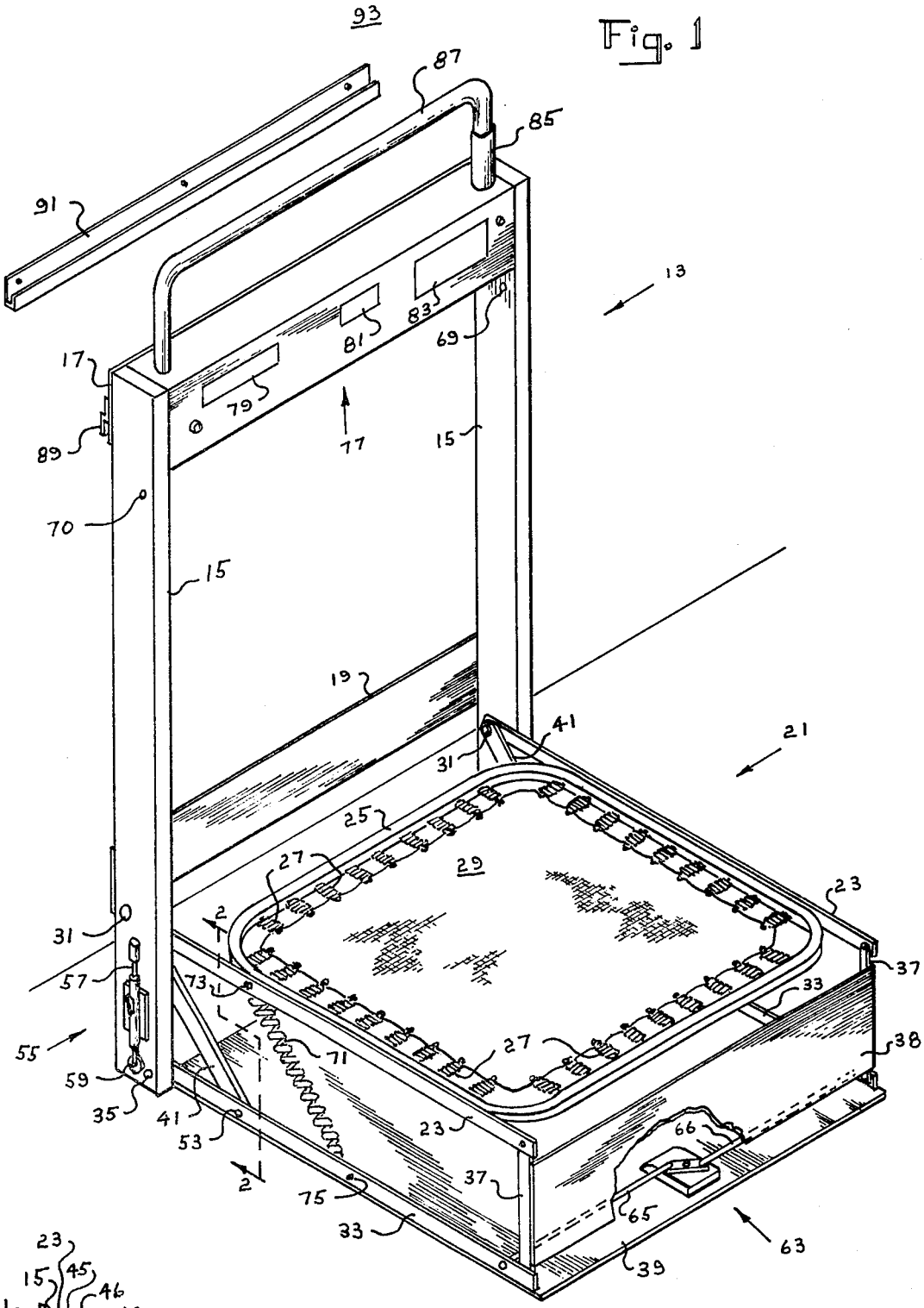
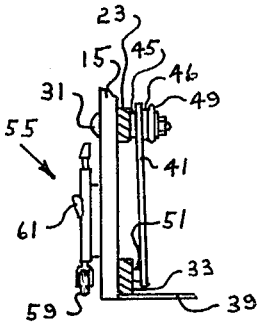
Fig. 2

FOLD-AWAY REBOUND EXERCISE DEVICE

BACKGROUND OF THE INVENTION

Along with the rise in popularity of rebound exercisers there has been an increased awareness of the potential and real safety hazards associated with their use.

One concern with conventional rebounders is their susceptibility to tipping over when the user's foot placement wanders near the outer edges of the rebounder.

In addition, conventional rebounders, because of their configuration, are not easily stored away and tend to be space consumptive. This includes wall mounted devices such as disclosed in U.S. Pat. No. 4,336,933 to P. Appelbaum which are non-portable, so as to provide no variety in storage locations, and which are also space consumptive. Thus, it is an object of the present invention to provide an exercise device for in-place jogging that has a full sized jogging platform that can be folded away into a significantly narrowed configuration and mounted into a housing that has a flat streamlined rectangular configuration for efficient storage and which is easily portable.

It is also an object of this invention to provide a rebounder that has very stable configuration and which is highly resistant to being tipped over.

Other objects and advantages of the invention will be apparent from a reading of the disclosure and claims which follow.

BRIEF SUMMARY OF THE INVENTION

Accordingly the present invention provides an apparatus for in-place jogging that includes a housing structure having spaced-apart side walls that define a storage cavity, and a support structure mounting a taut tramping material, which support structure is pivotally mounted to the lower portion of the housing for rotation to a first in-use position in which the support structure is locked at 90 degrees to the front of the housing structure and for rotation through 90 degrees, to a second, closed position in which the support structure is folded into a significantly reduced size to occupy the storage cavity of the housing. The invention includes biasing means for counterbalancing the gravitational force which tends to rotate the support structure towards its in-use position. The area covered by the bottom of the in-use support structure is greater than the area of the support structure top.

In a preferred embodiment there are retractable wheels mounted to the lower part of the housing. There is also a horizontally extending hand grasp attached to the upper part of the housing.

In one embodiment of the invention the housing is adapted to be mounted to a wall when the folded apparatus is wheeled into position against a wall and adjacent a wall-mounted receiving fixture, and then lowered into locking engagement with the fixture when the wheels are retracted.

BRIEF DESCRIPTION OF THE DRAWINGS

FIG. 1 is a view in perspective with parts broken away.

FIG. 2 is a sectional view taken along lines 2—2 of FIG. 1.

DETAILED DESCRIPTION OF THE INVENTION

As shown in FIG. 1 the apparatus of the invention includes a housing 13 which has sidewalls 15 of tubular aluminum alloy with rectangular cross-section. (To provide a strong lightweight structure all major components of the apparatus are constructed of aluminum). Upper cross-member 17 and lower cross-member 19 are welded to sidewalls 15 to provide a rigid housing 13. Mounted to the lower part of the housing 13 is jogging platform 21, which has upper frame arms 23 between which is affixed, by welding, a support hoop 25 which mounts, by way of a plurality of springs 27, a sheet 29 of strong flexible material such as canvas or glass fiber reinforced polyvinylchloride in a taut state. Rear ends of upper frame arms 23 are pivotally mounted to the lower portions of side walls 15 for rotation about horizontal axes through bolts 31. Platform 21 also has lower frame arms 33 which have rear ends that are pivotally mounted to sidewalls 15 by bolts 35. The front ends of upper frame arms 23 are rotatably connected to the front ends of lower arms 33 by way of vertically extending linking arms 37. The aforedescribed linkage of components of platform 21 maintains a generally parallel relationship between frame arms 23 and 33, and holds linking arms 37 generally vertical throughout rotation of platform 21. A front plate 38 is affixed to the front edges of linking arms 37. There is a generally flat baseplate 39 which is affixed to the lower edges of lower frame arms 33 and which engages the floor surface when the apparatus is in the configuration shown in FIG. 1.

The mechanism for locking the apparatus in the position shown in FIG. 1 includes locking arms 41 which are rotatably mounted to side walls 15 by bolt assemblies 31. As best shown in FIG. 2, each lock arm 41 is sandwiched by washers 45 and 46 and further embraced by rubber sleeve 49. An oversized bore in the upper, mounted ends of lock arms 41 allows some inward and outward movement of the lower end of arm 41, and the resiliency of rubber sleeve 49 provides for inward and outward resiliency of the lower ends of arms 41. As shown in FIG. 2 cylindrical locking pins 51 depend outwardly from the lower ends of locking arms 41 and will engage holes 53 in the lower frame arms 33 when aligned therewith. The lower ends of locking arms 41 and pins 51 are biased outwardly into engagement with the inner surfaces of frame members 33.

FIG. 2 also shows caster assembly 55 which is secured to the lower outer part of side walls 15 and which mounts a rod 57 having a caster wheel 59 at its lower end, and which is mounted for vertical movement from an up position above the lower edge of sidewall 15 in which position it is biased by a spring (not shown) and to a down position in which it automatically locks for engagement of wheel 59 with the floor. A release 61 is engagable to retract rod 57 to its up position. The entire structure of platform 21 in the space between side walls 15 and the lower end of display panel 77, in which position platform 21 may be locked by use of latch 63. During the rotation of platform 21 the lock arms 41 will rotate upwardly as they slidably engage inner surfaces of lower arms 33 and base plate 39.

If it is desirable to wall mount the apparatus, the caster assemblies 55 will be locked in wheel-down position. The apparatus is then maneuvered adjacent to wall 93 so that hanger 89 aligns with wall mount 91. Retraction of caster assembly 55 will lower hanger 89 into engagement with hanger 91.

Whereas the present invention has been described in particular relation to the above examples, it should be understood that other and further modifications, apart from these disclosed herein, may be made within the spirit and scope of the invention.

What is claimed is:

1. Apparatus for in-place jogging which is portable and adapted for mounting to a wall, comprising:

a. housing structure having spaced apart vertically extending side walls defining a storage cavity;

b. a trampoline support structure mounting a taut tramping material and having means for rotatably mounting said support structure to the lower end portion of said housing structure whereby said support structure and mounting means have a fold-away position completely within the confines of the cavity of said housing and whereby said support structure is rotatable through 90 degrees to a floor position, said trampoline support structure comprising a first support frame that is rotatably mounted at its rear end to locations near the lower extremities of said housing side walls, and a second support frame in which said tramping material is mounted and which is rotatably mounted at its rear end to locations on said housing side walls that are at a higher elevation than and rearward of the mounting locations of said first support frame, and vertically extending linking arms each having bottom ends pivotally mounted to the forward end portion of said first support frame and having top ends each pivotally mounted to the forward end portion of said second support frame;

c. means for locking said support structure in its fold-away position; and d. means for locking said support structure in its floor position comprising locking arms that have upper ends pivotally mounted in close proximity to rear end mounting locations of said second support frame, and lower ends that are biased to slidably engage said first support frame as said support structure is moved from its fold-away position to its floor position, said locking arms extending forwardly and downwardly and their lower ends making locking engagement with said first support frame when said support structure is in its floor position.

2. Apparatus for in-place jogging which is portable and adapted for mounting to a wall, comprising:

a. housing structure having spaced apart vertically extending side walls defining a storage cavity;

b. a trampoline support structure mounting a taut tramping material and having means for rotatably mounting said support structure to the lower end portion of said housing structure whereby said support structure and mounting means have a fold-away position completely within the confines of the cavity of said housing and whereby said support structure is rotatable through 90 degrees to a floor position; said trampoline support structure comprising a first support frame that is rotatably mounted at its rear end to locations near the lower extremities of said housing side walls, and a second support frame in which said tramping material is mounted and which is rotatably mounted at its rear end to locations on said housing side walls that are at a higher elevation than and rearward of the mounting locations of said first support frame, and vertically extending linking arms each having bottom ends pivotally mounted to the forward end portion of said first support frame and having top ends each pivotally mounted to the forward end portion of said second support frame;

c. means for locking said support structure in its fold-away position; and d. means for locking said support structure in its floor position comprising locking arms that have upper ends pivotally mounted to said housing sidewalls and co-axially with the rear ends of said second support frame, and said arms also being adapted at their upper portions to allow some inward and outward movement of their lower ends, and wherein said lower ends are biased outwardly to make slidable engagement with inner facing surfaces of said first support frame as said support structure is moved from its fold-away position to its floor position, said locking arms extending forwardly and downwardly and their lower ends making locking engagement with said first support frame when said support structure is in its floor position.

3. Apparatus as defined in claim 2 including means for biasing said locking arms outwardly that comprises a sleeve of resilient material mounted co-axially with, and inwardly of each of the upper ends of said locking arms.

* * * * *